US007511598B2

(12) United States Patent
Hall et al.

(10) Patent No.: US 7,511,598 B2
(45) Date of Patent: Mar. 31, 2009

(54) ELEMENT FOR USE IN AN INDUCTIVE COUPLER FOR DOWNHOLE COMPONENTS

(75) Inventors: David R. Hall, Provo, UT (US); Joe Fox, Spanish Fork, UT (US)

(73) Assignee: IntelliServ International Holding, Ltd. (KY)

( * ) Notice: Subject to any disclaimer, the term of this patent is extended or adjusted under 35 U.S.C. 154(b) by 0 days.

(21) Appl. No.: 11/833,557

(22) Filed: Aug. 3, 2007

(65) Prior Publication Data

US 2008/0074226 A1 Mar. 27, 2008

Related U.S. Application Data

(63) Continuation of application No. 10/878,244, filed on Jun. 28, 2004, now abandoned.

(51) Int. Cl.
*H01F 27/02* (2006.01)

(52) U.S. Cl. ..... 336/96

(58) Field of Classification Search ..... 336/96
See application file for complete search history.

(56) References Cited

U.S. PATENT DOCUMENTS

| | | | | |
|---|---|---|---|---|
| 6,717,501 | B2 * | 4/2004 | Hall et al. | 336/132 |
| 6,913,093 | B2 * | 7/2005 | Hall et al. | 175/57 |
| 2005/0140483 | A1 * | 6/2005 | Wobben | 336/182 |

* cited by examiner

*Primary Examiner*—Elvin G Enad
*Assistant Examiner*—Joselito Baisa
(74) *Attorney, Agent, or Firm*—Victor Segura; Jeffrey E. Daly

(57) ABSTRACT

An element for use in an inductive coupler for downhole components comprises an annular housing having a generally circular recess. The element further comprises a plurality of generally linear, magnetically conductive segments. Each segment includes a bottom portion, an inner wall portion, and an outer wall portion. The portions together define a generally linear trough from a first end to a second end of each segment. The segments are arranged adjacent to each other within the housing recess to form a generally circular trough. The ends of at least half of the segments are shaped such that the first end of one of the segments is complementary in form to the second end of an adjacent segment. In one embodiment, all of the ends are angled. Preferably, the first ends are angled with the same angle and the second ends are angled with the complementary angle.

7 Claims, 12 Drawing Sheets

ELEMENT FOR USE IN AN INDUCTIVE COUPLER FOR DOWNHOLE COMPONENTS

CROSS REFERENCE TO RELATED APPLICATIONS

This application is a Continuation of U.S. patent application Ser. No. 10/878,244 filed on Jun. 28, 2004 now abandoned.

FEDERAL SPONSORSHIP

This invention was made with government support under contract number No. DE-FC26-01NT41229 awarded by the Department of Energy. The government has certain rights in this invention.

BACKGROUND OF THE INVENTION

This invention relates to elements for use in inductive couplers for down-hole components, more specifically this invention relates to elements comprising segments of magnetically conductive material.

U.S. Pat. No. 6,670,880, which is herein incorporated by reference, discloses a downhole transmission system through a string of downhole components. A first transmission element is located in one end of each downhole component, which element includes a first magnetically conducting, electrically-insulating trough, and a first electrically conductive coil lying there in. A second data transmission element is located in the other end, with a similar arrangement comprising a second magnetically conducting, electrically-insulating trough and a second electrically conductive coil. The transmission system further comprises an electrical conductor in electrical communication with and running between each first and second coil in the downhole component. The string of downhole components is cooperatively arranged such that the elements are in magnetic communication with each other to thereby transmit signals through induction.

U.S. Pat. No. 6,670,880 discloses that the magnetically conductive troughs are preferably easily magnetized and demagnetized. Examples of magnetically conductive materials were given including soft iron, ferrite, nickel iron alloys, silicon iron alloys, cobalt iron alloys and mu-metals. One example of a nickel/iron alloy has a trade name of Permalloy, which is a compound that comprises about 20% iron and 80% nickel. A preferred magnetically conductive material is ferrite.

Rectangular segments are used as a substitute for a solid ring in the '880 patent. Naturally, a circular trough comprising rectangular segments creates gaps between its segments. Rectangles by definition are not curved and do not conform to the curve created by the circumferences of the circular trough. Thus, interruptions including generally triangular or trapezoidal shaped gaps in the trough result from using the rectangular segments. Because the gaps in the magnetically conducting circular trough do not contribute to magnifying the magnetic field, it is now believed that these gaps may adversely affect the magnetic field generated by the magnetically conductive, electrically insulating trough.

BRIEF SUMMARY OF THE INVENTION

An element for use in an inductive coupler for downhole components comprises an annular housing having a generally circular recess. The element further comprises a plurality of generally linear, magnetically conductive segments. Each segment includes a bottom portion, an inner wall portion, and an outer wall portion. The portions together define a generally linear trough from a first end to a second end of each segment. The segments are arranged adjacent to each other within the housing recess so as to form a generally circular trough. The ends of the segments are shaped such that the first end of each segment is complementary to the second end of an adjacent segment.

The shaped ends are preferably selected from the group consisting of a concave shape, a convex shape, a V-shape, and a zigzagged shape.

In another aspect of the present invention, the first and second ends of the segments are generally planar and the first ends are angled to be parallel to the second end of the adjacent segment. In one embodiment, all of the ends are angled. Preferably, the first ends of the segments are angled with the same angle and the second ends of the segments are angled with the complementary angle.

In one aspect of the present invention, all of the ends are angled so that the included angle between the outer wall portion and each end in each segment is calculated as 90°-180°/n, where n is the number of segments. In another aspect of the invention, every other segment arranged in the recess has two ends with an included angle between the outer wall portion and the two ends equal to 90°. The remaining segments have two ends with an included angle between the outer wall portion and the two ends calculated as 90°-360°/n, where n is the total number of segments.

Preferably, the annular housing is a metal ring. More preferably, the annular housing is a steel ring. In other embodiments the annular housing is a stainless steel ring. Preferably, the annular housing is disposed in a groove formed in the end of a downhole component. In one aspect of the present invention, the element comprises an electrically insulating filler material. Preferably, the filler material is a polymer selected from a group consisting of epoxy, natural rubber, fiberglass, carbon fiber composite, polyurethane, silicon, a fluorinated polymer, grease, polytetrafluoroethylene and perfluoroalkoxy, or a combination thereof.

In the preferred embodiment the magnetically conductive segments comprise an easily magnetized and easily de-magnetized material selected from the group consisting of soft iron, ferrite, a nickel iron alloy, a silicon iron alloy, a cobalt iron alloy, and a mumetal. Ferrite is the preferred material.

In another aspect of the present invention, the segments comprise a planar surface comprising both the inner wall portion and the outer wall portion which forms a chamfered edge with at least one of the ends.

The present invention provides the advantage that the parallel ends of the magnetically conductive segments may reduce gaps within the annular housing and thereby strengthen the magnetic field.

DETAILED DESCRIPTION OF THE INVENTION AND THE PREFERRED EMBODIMENT

The disclosed description is meant to illustrate the present invention and not limit its scope. Other embodiments of the present invention are possible within the scope and spirit of the claims.

Figure 1:
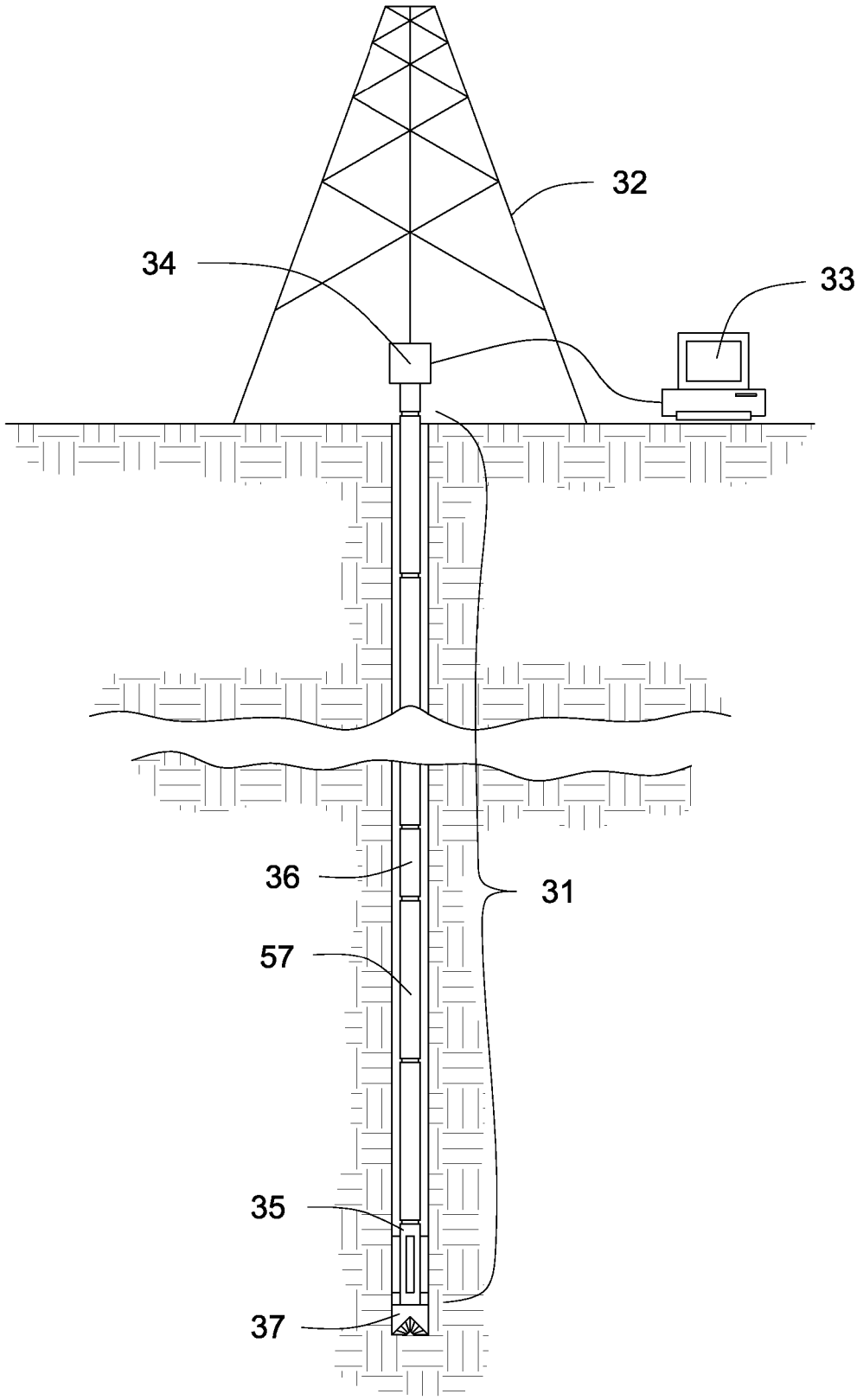
FIG. 1 is a cross sectional view of an embodiment of a downhole tool string.

FIG. 1 shows an embodiment of a downhole tool string 31 suspended in a well bore by a derrick 32. Surface equipment 33, such as a computer, connects to a data swivel 34. The data swivel 34 is adapted to transmit data to and from an integrated transmission network while the downhole tool string 31 is rotating. The integrated transmission network comprises the transmission systems of the individual components 35, 36, 57 of the downhole tool string 31. Preferably the downhole component is a tool 35.

Preferably the downhole component is a pipe 36, 57. Tools 35 may be located in the bottom hole assembly 37 or along the length of the downhole tool string 31. Examples of tools 35 on a bottom hole assembly 37 comprise sensors, drill bits, motors, hammers, and steering elements. Examples of tools 35 located along the downhole tool string 31 are links, jars, seismic sources, seismic receivers, sensors, and other tools that aid in the operations of the downhole tool string 31. Different sensors are useful downhole such as pressure sensors, temperature sensors, inclinometers, thermocouplers, accelerometers, and imaging devices. Preferably the downhole tool string 31 is a drill string. In other embodiments the downhole tool string 31 is part of a production well.

Figure 2:
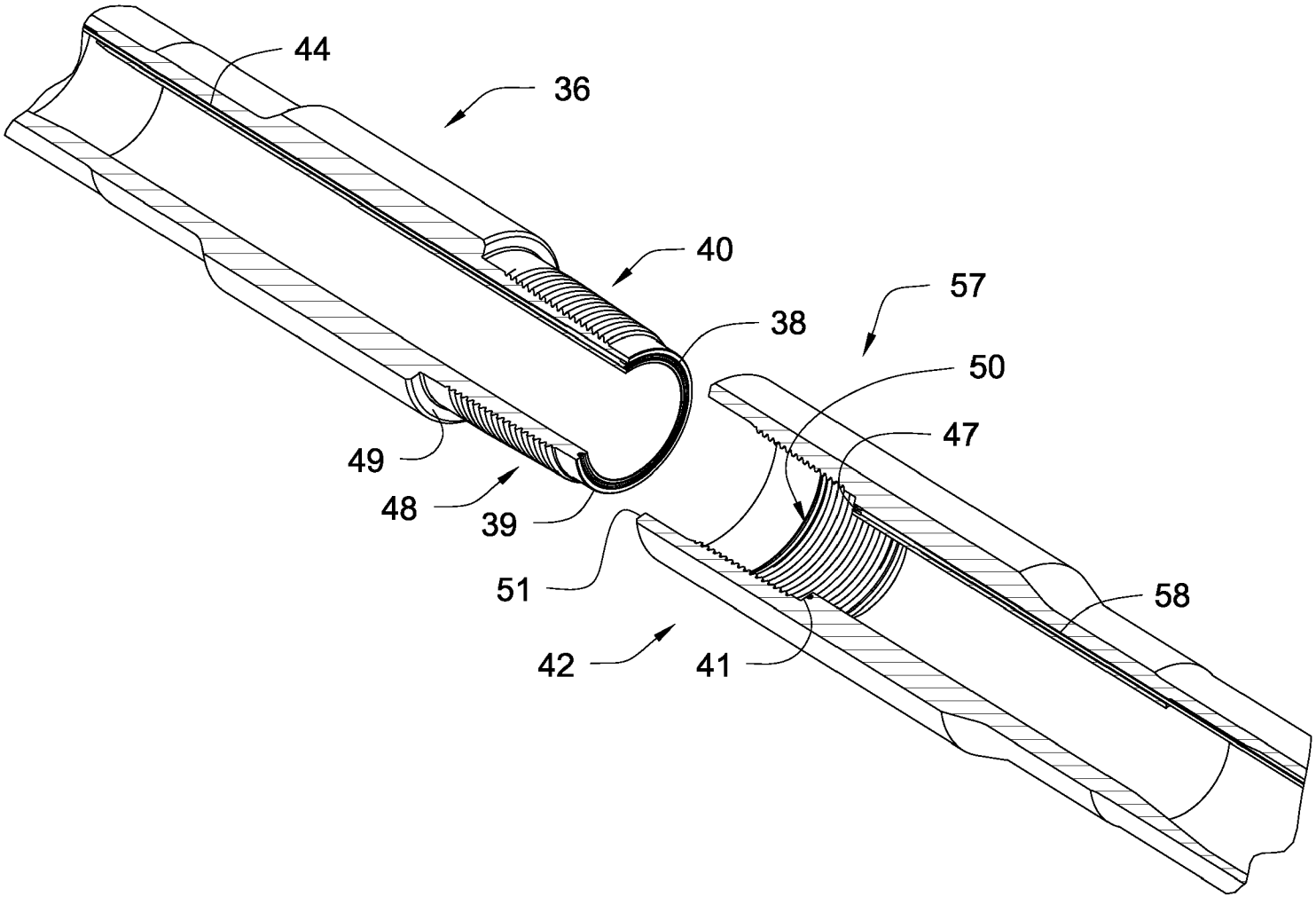
FIG. 2 is a perspective cross sectional view of an embodiment of the invention in downhole components.

The downhole tool string 31 is made up of components, as shown in FIG. 2. Preferably the components are pipes 36, 57 or some of the above mentioned tools 35. The components comprise inductive couplers 85 (shown in FIG. 3) located in the secondary shoulder 39 of the pin end 40 and the secondary shoulder 41 of the box end 42 of the component 36, 57. Preferably, the inductive couplers 85 comprise an element 38, 47 comprising an annular housing 43 (shown in FIG. 3) having a generally shaped recess 86 (shown in FIG. 12). The element 38, 47 further comprises a plurality of generally linear, magnetically conductive segments 68, each of which segments 68 includes a bottom portion 88, an inner wall portion 80, and an outer wall portion 79 (shown in FIG. 12). The portions 79, 80, 88 together define a generally linear trough 89 (shown in FIG. 3) from one end to the other end of each segment. The segments 68 are arranged within the housing recess 86 so as to form a generally circular trough 55. At least half of the ends 77, 78 (shown in FIG. 8) of the segments 68 are angled such that the ends 77, 78 of adjacent segments 68 are substantially parallel.

Preferably the element 38, 47 is disposed in an annular groove 62 (shown in FIG. 4) formed in the secondary shoulders 39, 41. Preferably the annular housing 43 is a metal ring. More preferably, the annular housing 43 is a steel ring. The elements 38, 47, in a single downhole component, are connected by an electrical conductor 44. Preferably the electrical conductor 44 is a coaxial cable.

Preferably the circular trough 55 houses an electrically conductive coil 45 embedded in the magnetically conductive segments 68. Preferably, the magnetically conductive segments 68 comprise an easily magnetized and de-magnetized material selected from the group consisting of soft iron, ferrite, a nickel iron alloy, a silicon iron alloy, a cobalt iron alloy and a mu-metal. More preferably the magnetically conductive segments 68 are made of ferrite. Preferably the coil 45 comprises at least two loops of insulated wire. More preferably, the coil 45 comprises one loop of insulated wire. The coil 45 may comprise two or more loops of insulated wire. More preferably the coil 45 comprises one loop of insulated wire. Preferably, the wire is made of copper and is insulated with an insulating layer 73 (shown in FIG. 12) of a varnish, enamel, or a polymer. When the components 36, 57 of the downhole tool string 31 up are made, the elements 38, 47 line up adjacent each other and allow data transmission between the components 36, 57. A threaded portion 48 located between the primary shoulder 49 and secondary shoulder 39 of the pin end 40 and a threaded portion 50 located between the primary shoulder 51 and secondary shoulder 41 of the box end 42 provide a means of attachment for the downhole components 36, 57.

Figure 3:
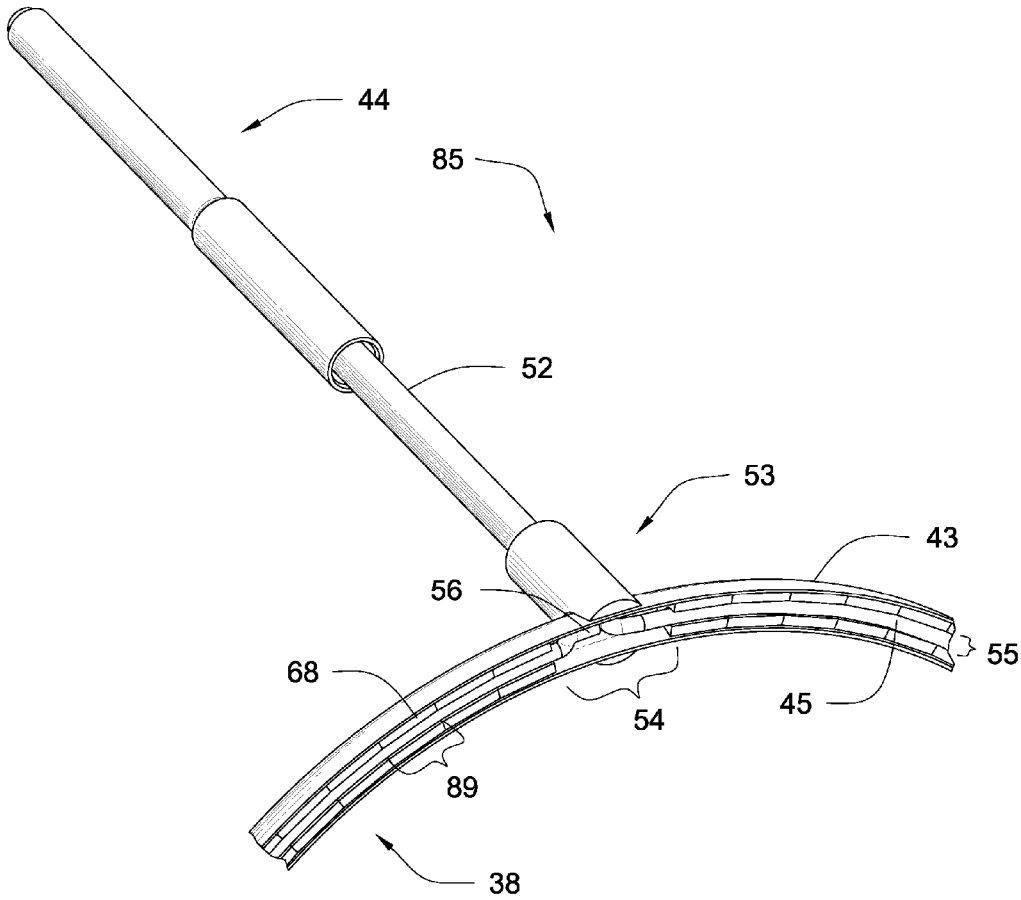
FIG. 3 is a perspective view of an embodiment of an inductive coupler.

FIG. 3 shows an embodiment of a connection between the electrical conductor 44 and the electrical conducting coil 45. In the preferred embodiment, a signal travels along the electrical conductor 44 of a downhole component 36. The signal passes from the electrical conductor 44 to a lead wire 52 of the coil 45. The inductive coupler 85 comprises an anti-rotation device 53, which keeps the annular housing 43 from rotating about the axis of the lead wire 52. In the preferred embodiment the lead wire 52 may enter the annular housing 43 through a hole 75 (shown in FIG. 5) in the annular housing 43, where there is a void 54 of magnetically conductive material. The coil 45 is housed within the circular trough 55 of magnetically conductive material and is grounded to the annular housing 43 in the void 54 of the magnetically conductive material.

Preferably, the grounded portion 56 of the coil 45 is brazed to the annular housing 43. In some embodiments of the present invention, the coil 45 and magnetically conductive segments 68 are disposed in a groove 62 formed in the secondary shoulders 39, 41 of both the pin end 40 and also in the box end 42 of the down-hole component 36. Preferably, the elements 38, 47 comprise an electrically insulating filler material 60 (shown in FIG. 12) which holds the segmented circular trough 55 in place. Preferably the filler material 60 is a polymer selected from the group consisting of epoxy, natural rubber, fiberglass, carbon fiber composite, polyurethane, silicon, a fluorinated polymer, grease, polytetrafluoroethylene and perfluoroalkoxy, fluorinated ethylene propylene copolymer (FEP), or a combination thereof. Polytetrafluoroethylene and perfluoroalkoxy are the more preferred filler materials 60, with FEP grade 6100 the most preferred material.

It is important that the electrically-insulating filler material 60 withstand the elevated pressures and temperatures in downhole conditions. Consequently, it is preferred to treat the filler material 60 to make sure that it does not contain any air pockets. Preferably the filler material 60 is centrifuged to remove all bubbles that might be introduced during mixing. One such treatment method involves subjecting the filler material 60 in a centrifuge. A most preferred form of this method subjects the material 60 to a centrifuge at between 2500 to 5000 rpm for about 0.5 to 3 minutes.

Figure 4:
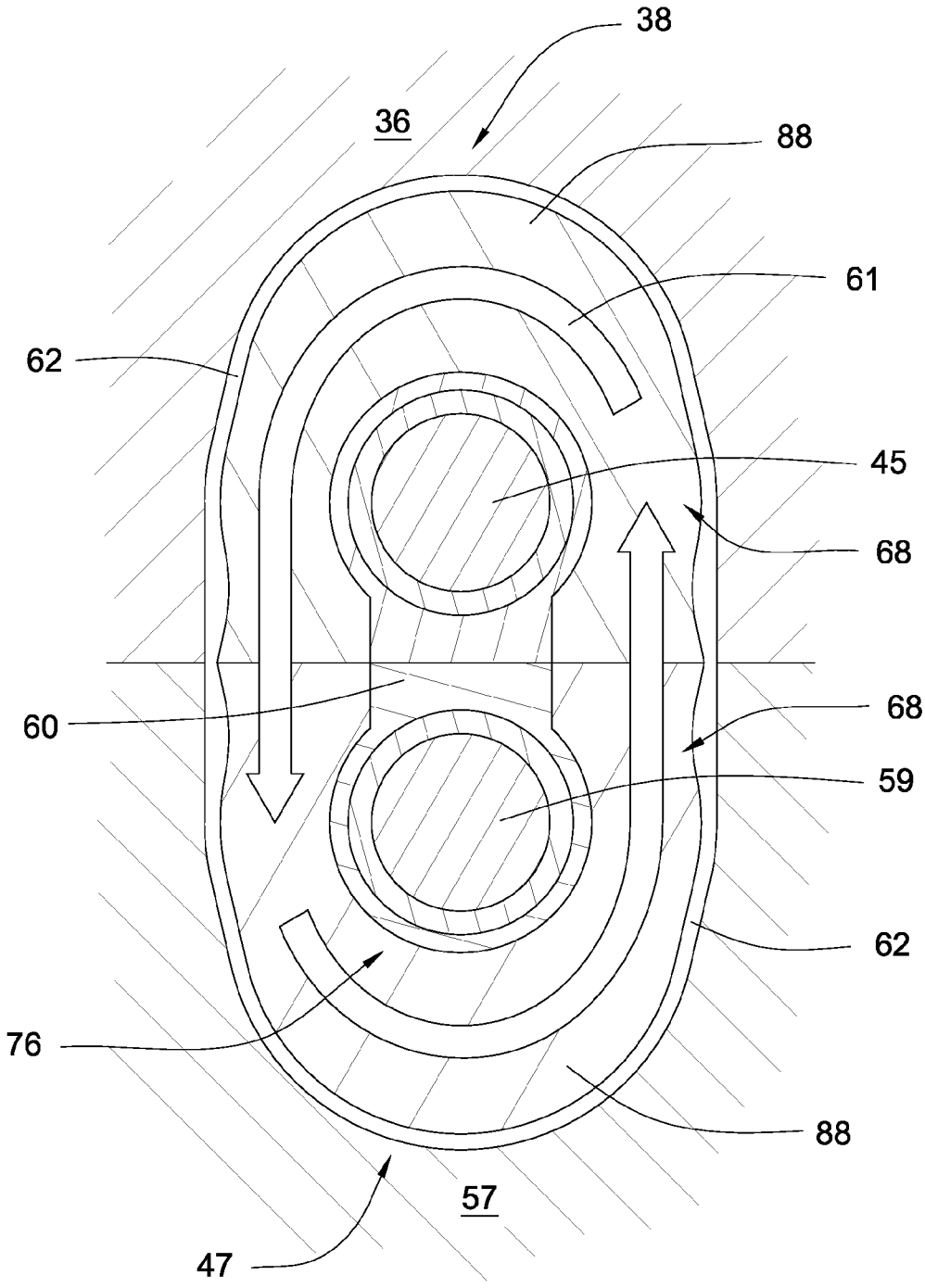
FIG. 4 is a cross-sectional view of an embodiment of a magnetic transmission circuit.

FIG. 4 shows an embodiment of the magnetic transmission circuit 61 formed by cooperating magnetic fields. As the signal travels along the coil 45, the magnetic field from the electrical current is concentrated by the magnetically conductive segments 68. The concentrated magnetic field influences the magnetically conductive segments 68 in the adjacent element 47 in the adjacent downhole component 57. The electrically conducting coils 45, 59 are arranged in a manner to allow the magnetic fields to generate a magnetic transmission circuit 61. A magnetic transmission circuit 61 may be allowed by disposing one coil 45 in a clockwise direction in the segmented circular trough 55 and disposing an adjacent coil 59 in a counterclockwise direction in an adjacent segmented circular trough 76. The coil 59 in the adjacent element 47 is influenced by the magnetic transmission circuit 61 to generate an electrical current and that signal is passed to the electrical conductor 58 in the adjacent downhole component 57.

Figure 5:
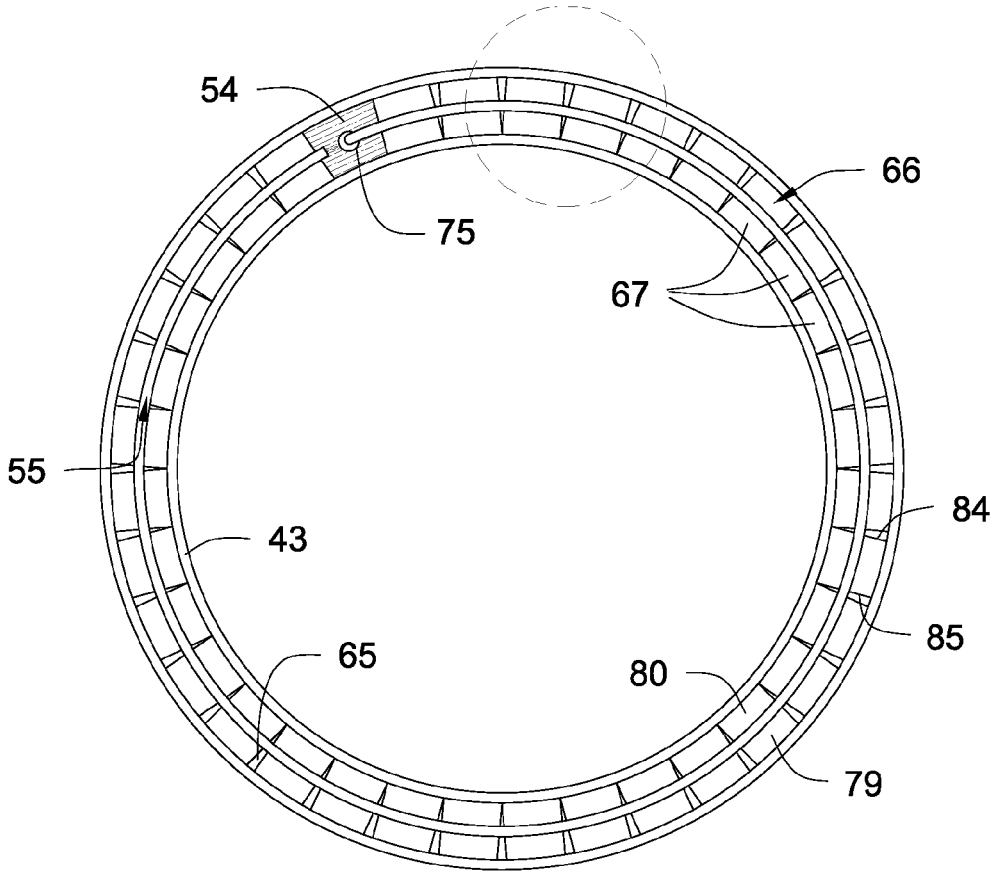
Fig. 5 Prior Art
FIG. 5 is an orthogonal view of an element (prior art).
Figure 6:
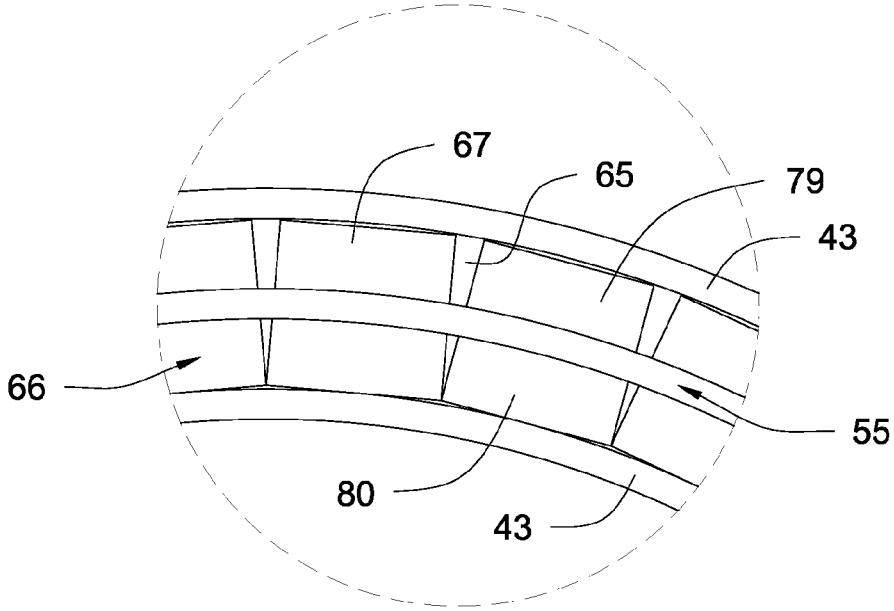
Fig. 6 Prior Art
FIG. 6 is a detailed view of a section of FIG. 5 (prior art).

FIGS. 5 and 6 show the prior art using rectangular segments 67. Rectangular segments 67 of magnetically conductive material necessarily leave gaps 65 in the circular trough 55. It is believed that a MCEI trough formed with these gaps provide a magnetic field and allow transmission.

Angled ends 77, 78 (shown in FIG. 8) of the magnetically conductive segments 68, may reduce the gaps 65 significantly as the ends are complementary. Elements 38, 47 with rectangular segments 67 lose a percentage of the signal strength passed between them. Repeaters, which are included throughout the downhole tool string 31, are used to strengthen the diminished signals. It is believed that by reducing the size of the gaps 65 in the annular housing 43, that a stronger magnetic field is generated, which results in passing a stronger signal between the elements 38, 47.

Figure 7:
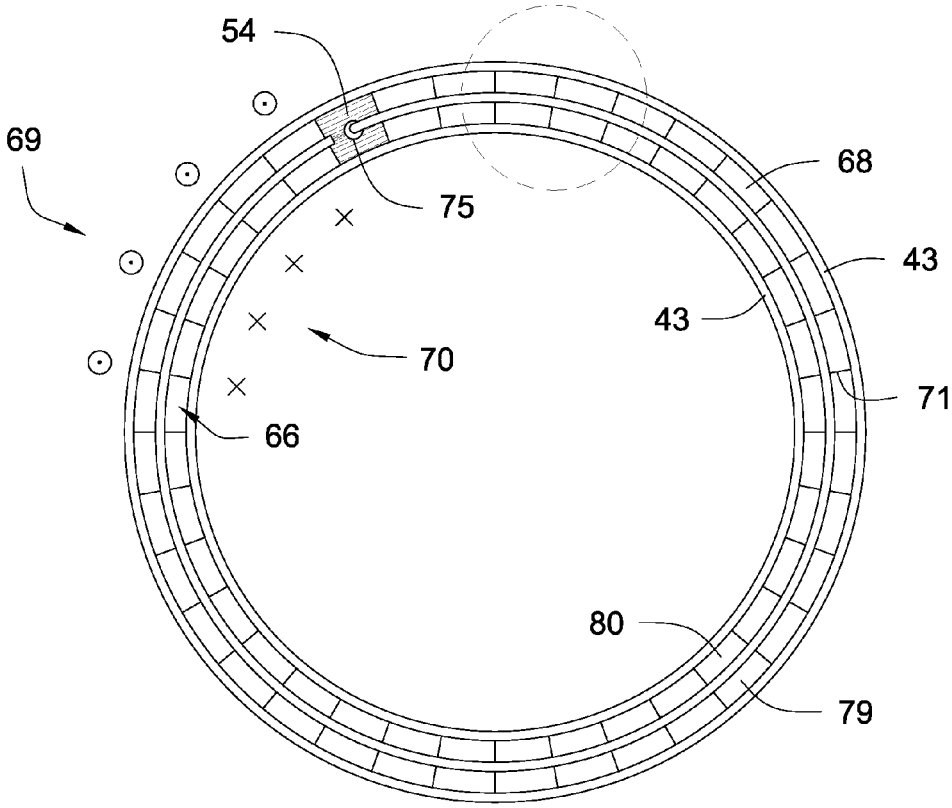
FIG. 7 is an orthogonal view of an embodiment of an element.
Figure 8:
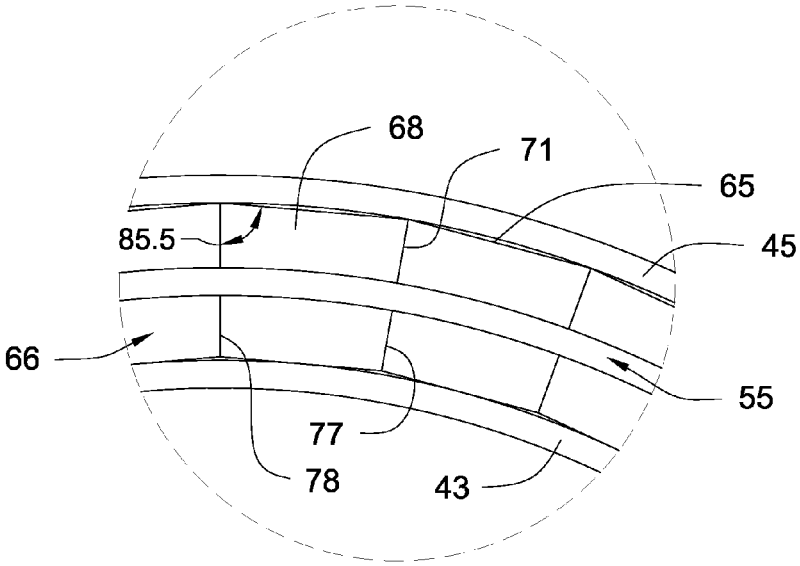
FIG. 8 is a detailed view of a section of FIG. 7.

FIG. 7 shows an embodiment of an element 38 wherein all of the ends 77, 78 are angled. FIG. 8 is a detailed view of a portion of FIG. 7. In the preferred embodiment of the present invention, all of the one ends 77 of the segments 68 are angled with the same angle and all of the other ends 78 of the segment 68 are angled with the complementary angle. The magnetic transmission circuit 61 is represented coming out of the page by 69 and represented going into the page by 70. Since the one end 77 in this embodiment is planar and generally parallel to the other end 78, the segments 68 may be arranged in the annular housing 43 such that minimal gaps 71 are formed. As used herein a minimal gap refers to a gap of between about 0.050 and 0.0001 inches. It is believed that the minimal gaps 71 have a negligible adverse affect on the magnetic transmission circuit 61.

In one aspect of the present invention, all of the ends 77, 78 are angled in a complementary fashion so that the included angle between the outer wall portion 79 and each end 77, 78 in each segment 68 is calculated as 90°-180°/n, wherein n is the number of segments 68. For example if the annular housing 43 comprised forty segments 68, all with angled edges 77, 78 and are arranged to form minimal gaps 71 with no voids 54 in the annular housing 43, then the included angle between the outer wall portion 79 and each end 77, 78 would be 85.5°.

Figure 9:
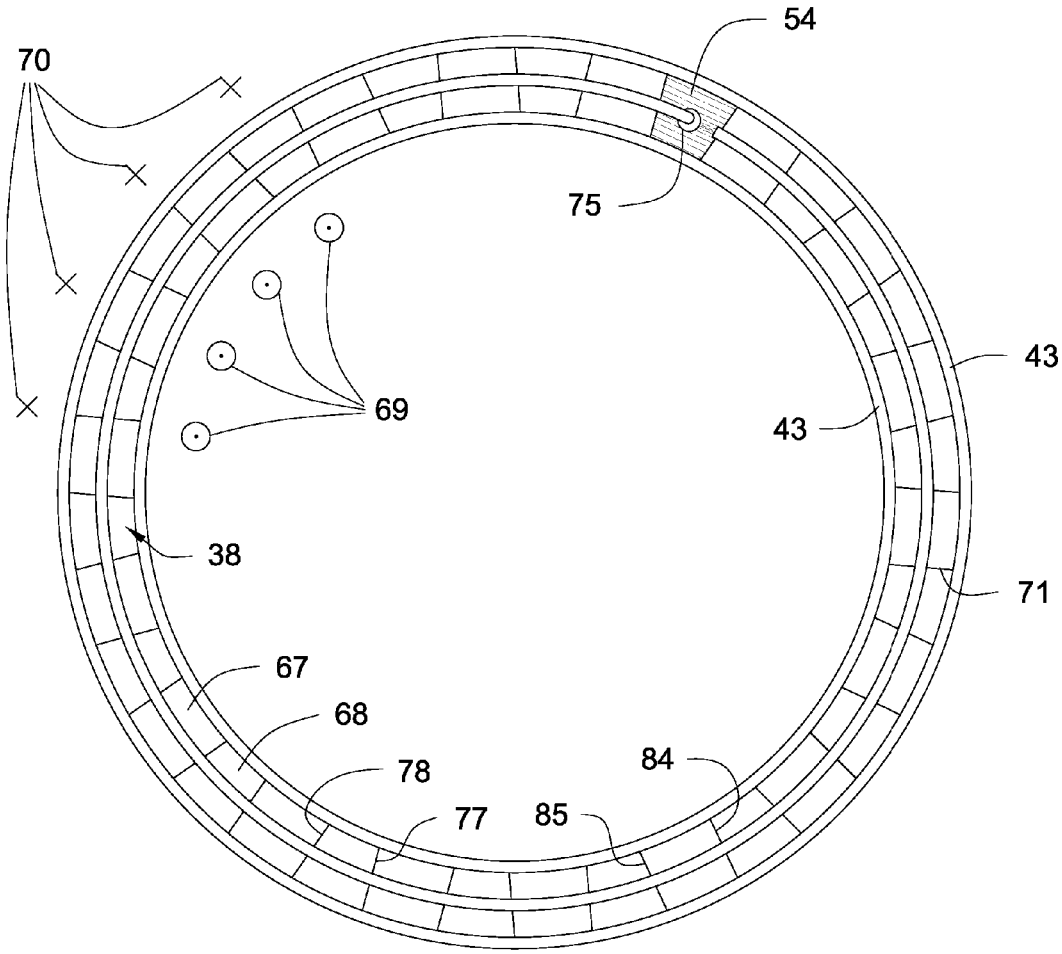
FIG. 9 is an orthogonal view of an embodiment of an element.

In another aspect of the present invention is shown in FIG. 9, every other segment 67 arranged in the recess 86 has two ends 84, 85 with an included angle between the outer wall portion 79 and the two ends 84, 85 equal to 90°, and wherein the remaining segments 68 have two ends 77, 78 arranged in a complementary manner with an included angle between the outer wall portion 79 and the two ends 77, 78 calculated as 90°-360°/n, where n is the total number of segments 67, 68. An embodiment is show in FIG. 9. An example illustrates that if the annular housing 43 comprised forty segments 67, 68, half of which were rectangular segments 67, and all the segments 67, 68 are arranged such so as to form minimal gaps 71 and that there are no voids 54, then the angle included between the outer wall portion 79 and the angled ends 77, 78 would be 81°.

FIG. 9 also illustrates a magnetic transmission circuit 61 running in an opposite direction as shown in FIG. 7, due to the electrically conducting coil 45 running in a counterclockwise direction.

Figure 10:
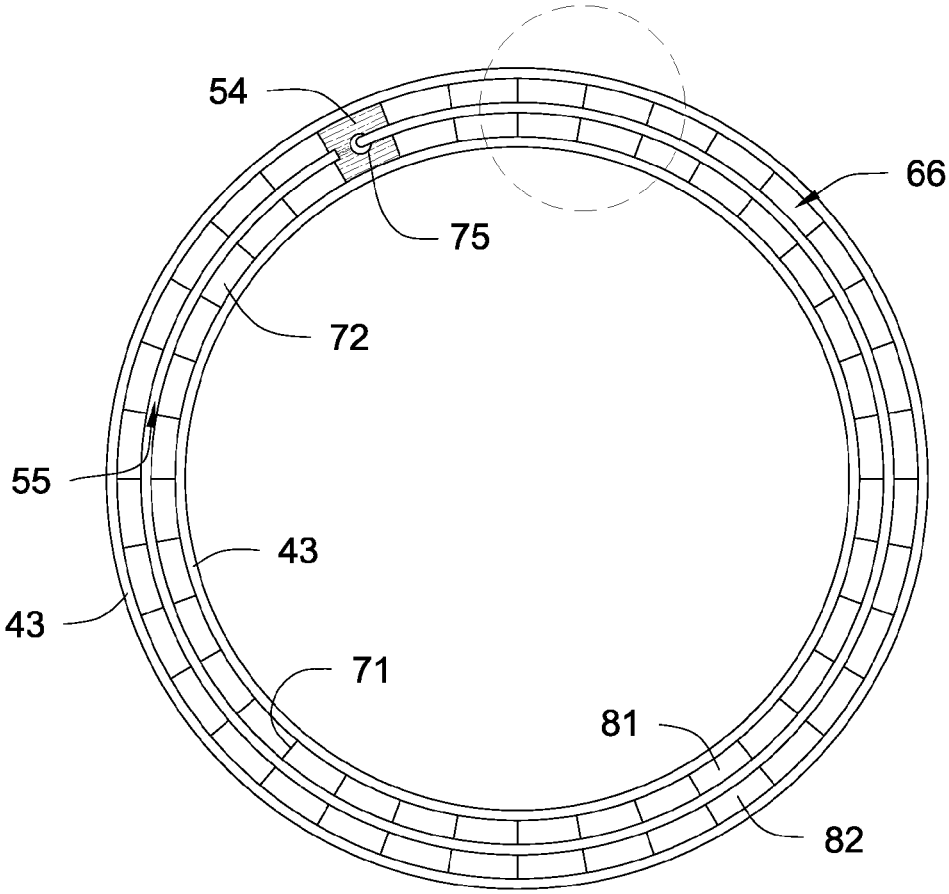
FIG. 10 is an orthogonal view of an embodiment of an element.
Figure 11:
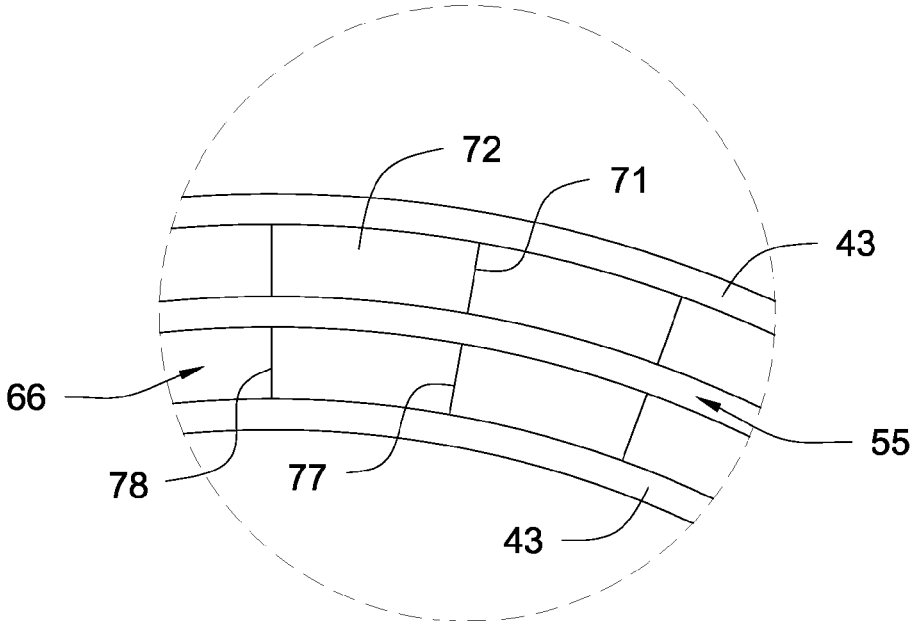
FIG. 11 is a detailed view of a section of FIG. 10.
Figure 12:
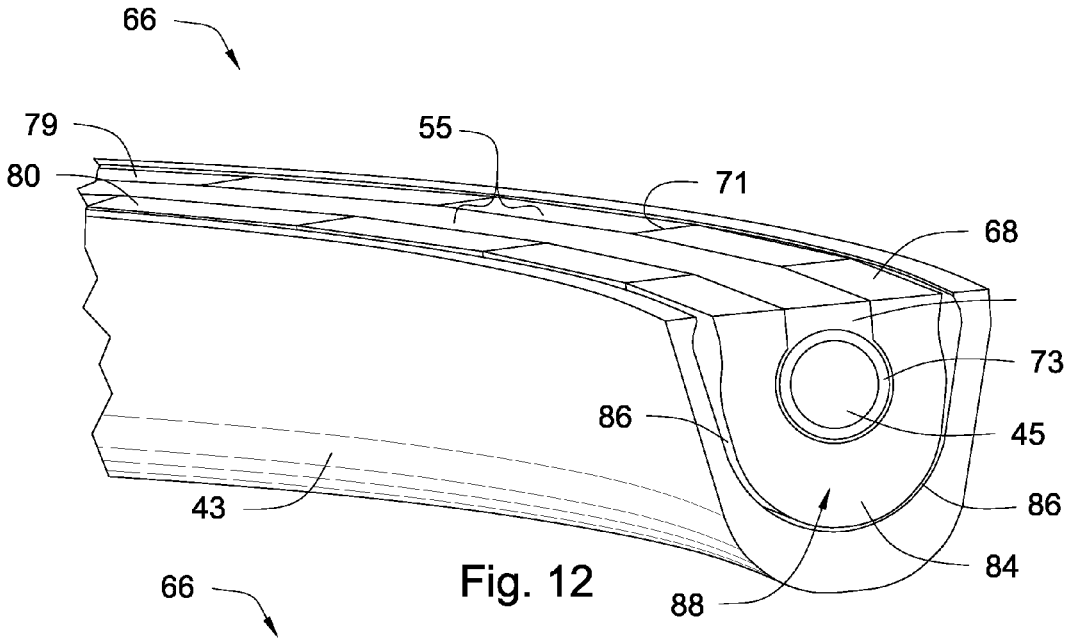
FIG. 12 is a partial perspective view of an embodiment of an element.
Figure 13:
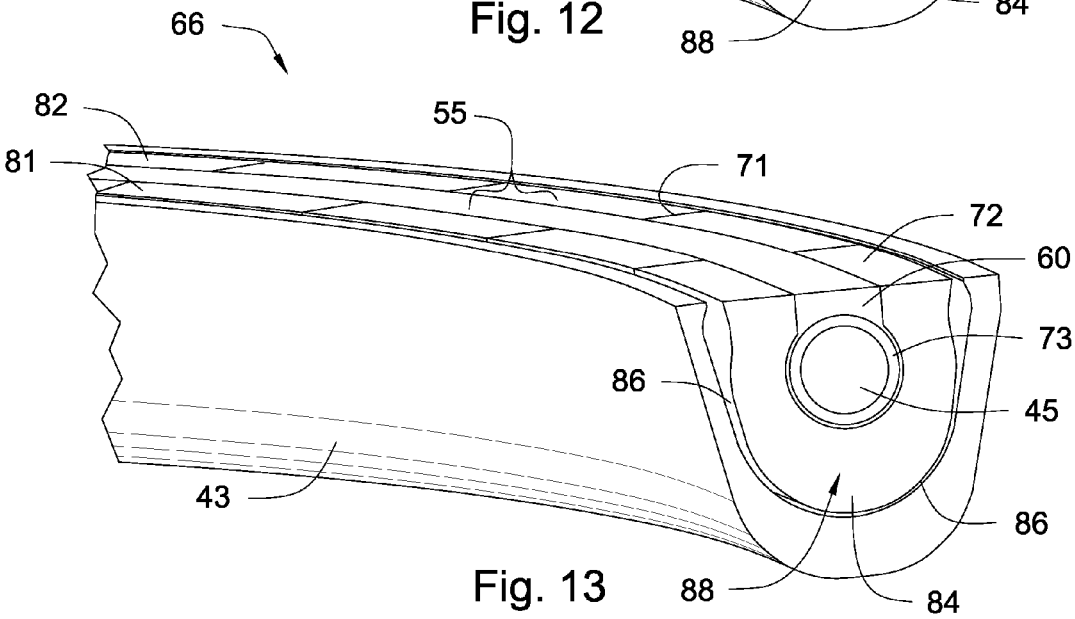
FIG. 13 is a partial perspective view of an embodiment of an element.

FIG. 10 shows an embodiment of generally linear shaped segments 72 comprising curved inner wall portions 81 and curved outer wall portions 82. The first end 77 and the second ends 78 of the segments 72 are shaped such that the first end 77 of each segment 72 is complementary to the second end 78 of adjacent segments. Some small gaps may still be present between these annular housing 43 and the magnetically conductive segments 72; however, these gaps are believed to have less impact on the strength of the magnetic field, and are smaller than the gaps 65 created by the segments 68 with angled ends 77, 78 and the annular housing 43. In order for the current in the electrically conducting coil 45 to influence the magnetically conductive segments 67, 68, 72 to generate a magnetic field, the electrically conducting coil 45 needs to be at least partially encapsulated in the magnetically conductive material. Other factors such as the number of loops in the electrically conducting coil 45, the thickness of the electrically conducting coil 45, and the length of the cross section of magnetically conductive circular trough 55, all have positive direct relationships with the strength of the magnetic transmission circuit 61. The gaps 65 that are present between the annular housing 43 and the segments 68 affect the strength of the magnetic field by decreasing the thickness of the cross section of the circular trough 55, which is believed to be considerably less than the impact that the gaps 65 formed between the segments 68 and the annular housing 43 have on the magnetic field strength. FIG. 11 shows a detailed view of the FIG. 10. FIG. 12 is a perspective view of an element. FIG. 13 is a perspective view of FIG. 10.

Figure 14:
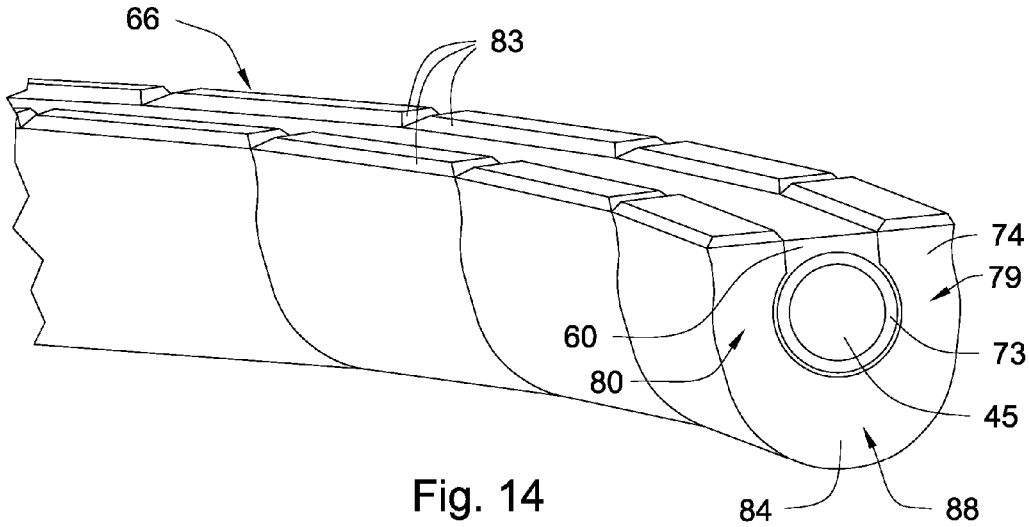
FIG. 14 is a partial perspective view of an embodiment of an element.

FIG. 14 shows an embodiment of the present invention wherein the segments 74 comprise a planar surface 66 comprising both the inner wall portion 80 and the outer wall portion 79 which forms a chamfered edge 83 with at least one of the ends 77, 78. When attaching the downhole components 36, 57 in a down-hole tool string 31, the planar surfaces 66 slide together under some friction. Depending on the pitch and other factors dealing with the threaded portion 48 on the pipe, the planar surfaces 66 may slide against each other for 5 to 30 degrees. However, 5 to 10 degrees is more likely. The chamfered edge 83 prevents the ends 77, 78, 84, 85 of the segments 74 from catching while the planar surfaces 66 are sliding against each other. Ideally the surfaces 66 are coated with the filler material 60 and then grinded down to provide a smooth surface 66, but if a segment 67, 68, 72 is popped out of the recess 86 a little bit, the planar surfaces 66 of one of the elements 38, 47 may be damaged. Popped up segments 67, 68, 72 may be destroyed or create a gap, such as a groove, scratch, or crack in one of the planar surfaces 66 which may adversely affect the magnetic transmission circuit 61. When the planar surface 66 is being finished, it is important that the polishing procedures do not compromise the surface 66 in such a way as to interfere with the magnetic transmission circuit 61.

It is believed that the electrical signal passed between the elements 38, 47 is stronger when the planar surfaces 66 are in physical contact with each other. It is believed, that the physical contact between the planar surfaces 66 increases the cross section of the magnetically conductive material, and this increases the magnetic field. Sometimes rocks or dirt keep the planar surfaces 66 from touching each other. The signal may still pass between the elements 38, 47, even if the planar surfaces 66 aren't touching because the magnetic transmission circuit 61 may still be made, but the signal is weaker. It is believed that if a small space exists, then air's magnetic resistance adversely affects the magnetic fields. A rock or some other object may dislodge one or more of the segments 67, 68, 72, but it is believed that segments 74 with chamfered edges 83 may reduce the frequency that it happens.

A method of forming an element 38, 47 of magnetically conductive segments 67, 68, 72, 74 begins with providing a mold having a trough conforming to the final dimensions of the circular trough 55. A two-part, heat-curable epoxy formulation is mixed in a centrifuge cup, to which the individual magnetically conductive segments 67, 68, 72, 74 and a length of fiberglass rope are added. The parts are centrifuged for up to 30 minutes to cause all bubbles induced by mixing to rise out of the viscous liquid, and to cause the liquid to penetrate and seal any porosity in the magnetically conductive material. The fiberglass rope is then laid in the bottom of the mold, which is either made from a material, which does not bond to epoxy, such as polymerized tetrafluoroethane or which is coated with a mold release agent. The individual magnetically conductive segments 67, 68, 72, 74 are then placed on top of the fiberglass rope, to fill the circle. Any excess epoxy is wiped out of the groove. The planar surfaces 66 of the parts may be precisely aligned with each other by holding them in position with magnets placed around the circular trough in the mold. After the epoxy is cured, either at room temperature or in an oven, the circular tough 46 is removed from the mold. Other filler materials may be used in the place of epoxy such as the filler materials mentioned above.

Figure 15:
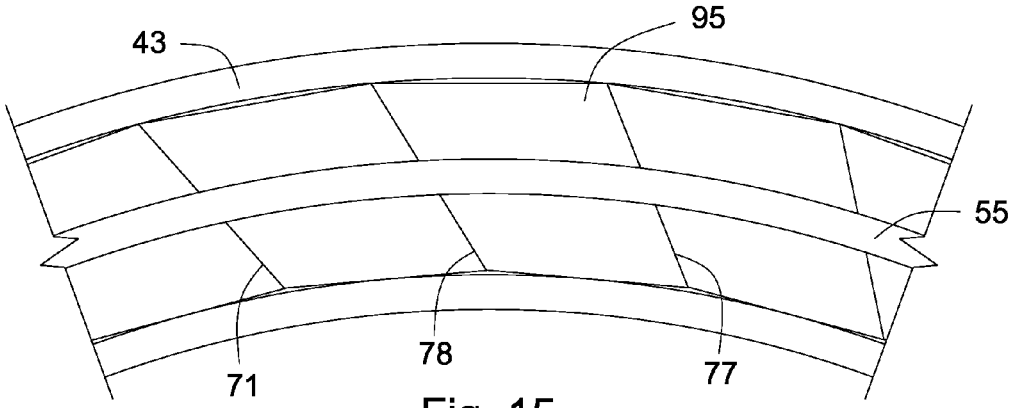
FIG. 15 is a partial orthogonal view of an embodiment of an element.
Figure 16:
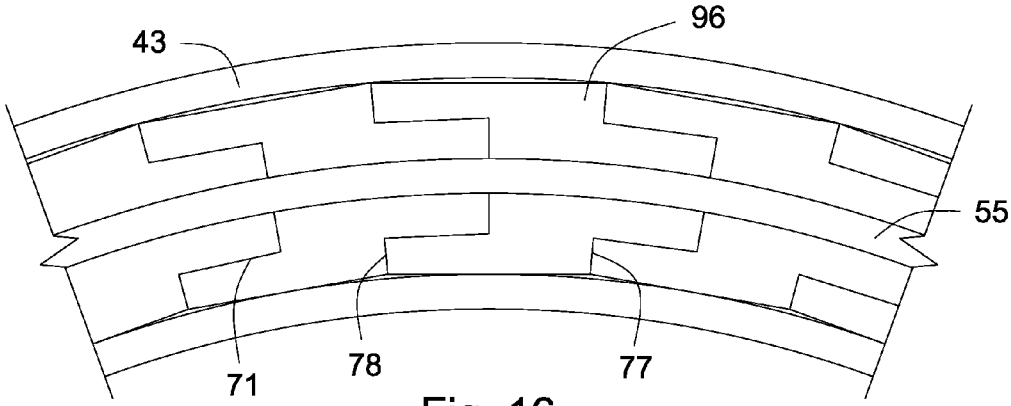
FIG. 16 is a partial orthogonal view of an embodiment of an element.
Figure 17:
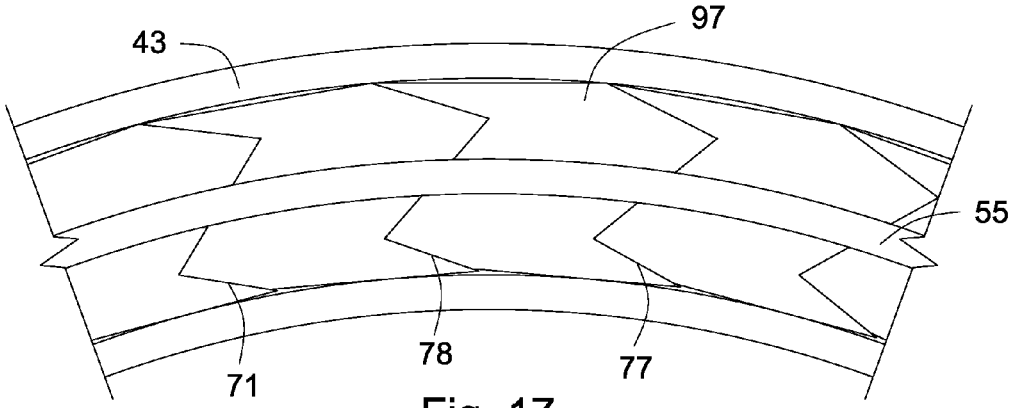
FIG. 17 is a partial orthogonal view of an embodiment of an element.
Figure 18:
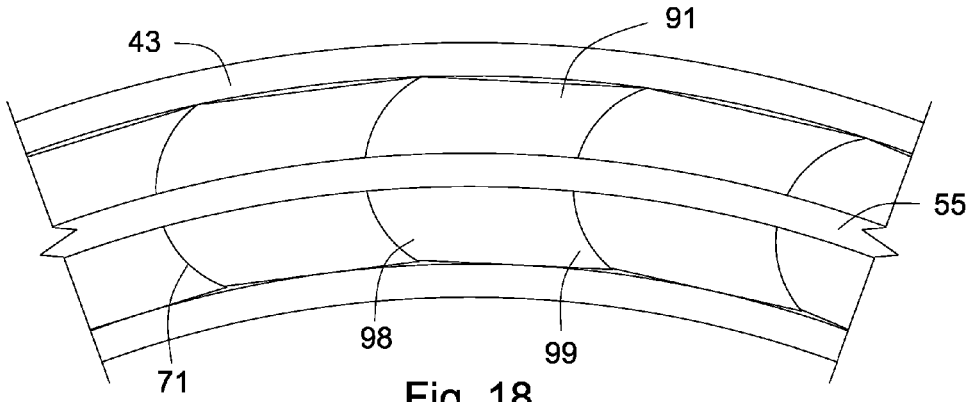
FIG. 18 is a partial orthogonal view of an embodiment of an element.
Figure 19:
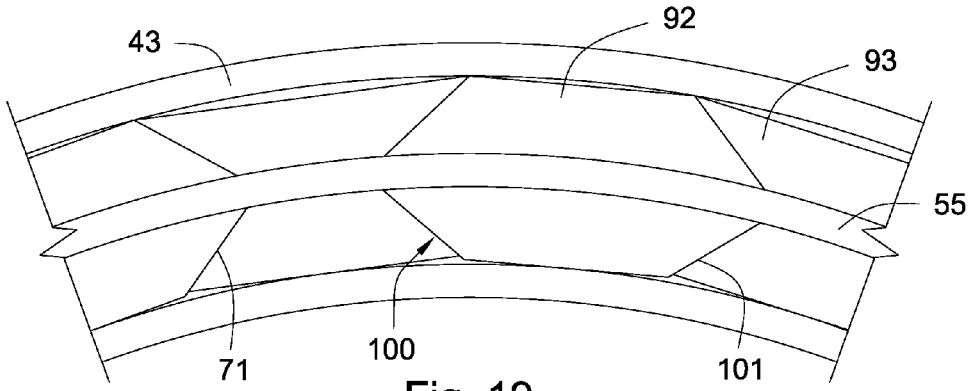
FIG. 19 is a partial orthogonal view of an embodiment of an element.
Figure 20:
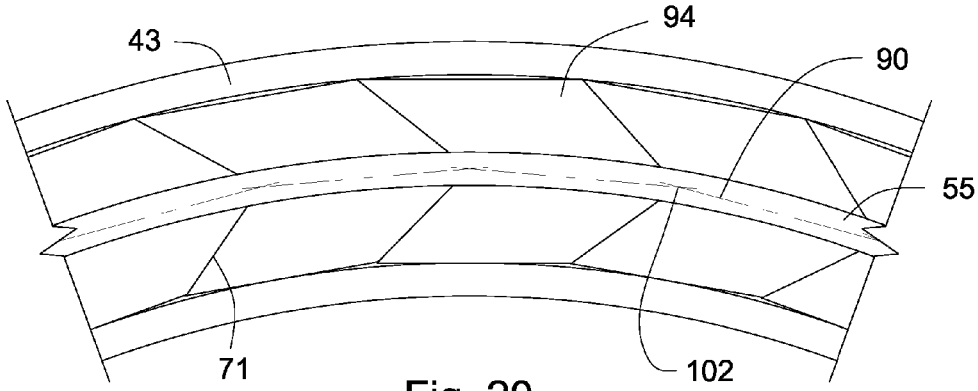
FIG. 20 is a partial orthogonal view of an embodiment of an element.

FIG. 15 shows an embodiment of an element comprising diamond shaped segments 95. Complementary ends 78 and 77 are arranged in the housing 43 to fit to form a minimal gap 71, which is believed to not adversely affect the magnetic transmission circuit. FIG. 16 shows an embodiment comprising interlocking segments 96 having non-planar ends. Non-planar end 77 is inserted into complementary end 78 and is believed to produce a minimal gap 71 between the segments 96. Zigzagged shaped non-planar segments 97 are shown in FIG. 17. FIG. 18 shows an embodiment of a segment 91 with a concave shaped non-planar end 99 and a convex shaped non-planar end 98. The concave shaped end 99 may be rotated in the complementary convex end 98 so that gaps 65 between the segment 91 and the annular housing 43 may be minimized and the gap between segments 91 may be minimal gaps 71. FIG. 19 shows segments 92, 93 comprising V-shaped ends 100, 101. Segment 92 comprising two out-ward V-shaped ends 100 and segment 93 comprising two complementary inward V-shaped ends 101. In FIG. 20 an embodiment of a segment 94 comprising both an inward V-shaped end 101 and an outward V-shaped end 100 is shown. Also shown in FIG. 20 is a longitudinal axis 90 of one of the segments 94. In some embodiments, the longitudinal axis 90 runs from one 77 end of the segment 94 to the other end 78. The segments 68 may be arranged such that their longitudinal axes 90 intercept at a point 102 which is intermediate the two segments 68.

Whereas the present invention has been described in particular relation to the drawings attached hereto, it should be understood that other and further modifications apart from those shown or suggested herein, may be made within the scope and spirit of the present invention.

What is claimed is:

1. An element for use in an inductive coupler for downhole components comprising:

an annular housing having a generally circular recess and configured to mount on an end of a component configured for subsurface use; and a plurality of magnetically conductive segments arranged in the housing, each segment having a bottom portion, a planar surface opposite the bottom portion, an inner wall portion and an outer wall portion defining a trough from a first end to a second end of each segment, the first ends of each of the segments arranged to engage the second ends of their adjacent segments within the housing recess in a manner so as to form a generally circular trough;

wherein the first and second ends of the segments are shaped such that the first end of each segment is complementary to and radially interlocking with the second end of the adjacent segment; and wherein the planar surface of each segment comprises a planar surface comprising both the inner wall portion and the outer wall portion which forms a chamfered edge with at least one of the ends.

2. The element of claim 1, wherein the shape of the first end of at least half of the segments is selected from the group consisting of a concave shape and a convex shape.

3. The element of claim 1 wherein the annular housing is a metal ring.

4. The element of claim 1 wherein the annular housing is disposed in a groove formed in the end of the downhole component.

5. The element of claim 1 wherein the element comprises an electrically insulating filler material.

6. The element of claim 5 wherein the filler material is a polymer selected from a group consisting of epoxy, natural rubber, fiberglass, carbon fiber composite polyurethane, silicon, a fluorinated polymer, grease, polytetrafluoro-ethylene and perfluoroalkoxy, or a combination thereof.

7. The element of claim 1 wherein the magnetically conductive segments comprise an easily magnetized and easily de-magnetized material selected from the group consisting of soft iron, ferrite, a nickel iron alloy, a silicon iron alloy, a cobalt iron alloy, and a mu-metal.

* * * * *